US006997129B2

(12) United States Patent
Rabal

(10) Patent No.: US 6,997,129 B2
(45) Date of Patent: Feb. 14, 2006

(54) APPARATUS, AND ASSOCIATED METHOD, FOR OPERATING A LID TO A HATCH

(75) Inventor: Clifford R. Rabal, Wills Point, TX (US)

(73) Assignee: Skeeter Products, Inc., Kilgore, TX (US)

( * ) Notice: Subject to any disclaimer, the term of this patent is extended or adjusted under 35 U.S.C. 154(b) by 0 days.

(21) Appl. No.: 10/382,128

(22) Filed: Mar. 4, 2003

(65) Prior Publication Data

US 2004/0011266 A1 Jan. 22, 2004

Related U.S. Application Data

(60) Provisional application No. 60/361,566, filed on Mar. 4, 2002.

(51) Int. Cl.
*B63B 19/14* (2006.01)

(52) U.S. Cl. ..... 114/203

(58) Field of Classification Search ..... 114/201 R, 114/203; 292/256.5, 95, 121, 129, 194, 219, 292/229; 174/66, 67
See application file for complete search history.

(56) References Cited

U.S. PATENT DOCUMENTS

| | | | | |
|---|---|---|---|---|
| 86,686 | A | | 2/1869 | Peterson |
| 274,497 | A | | 3/1883 | Judson |
| 527,627 | A | | 10/1894 | Spengler |
| 557,602 | A | | 4/1896 | Pletcher |
| 758,441 | A | | 4/1904 | Harden |
| 786,585 | A | | 4/1905 | Johnson |
| 844,691 | A | | 2/1907 | Russell |
| 848,034 | A | | 3/1907 | Husemann |
| 975,528 | A | | 11/1910 | Hynd |
| 1,416,499 | A | * | 5/1922 | Newcomb ..... 114/201 R |
| 1,807,910 | A | | 6/1931 | Garbell |
| 1,807,911 | A | | 6/1931 | Garbell |
| 2,000,839 | A | | 5/1935 | Hanlon |
| 2,930,645 | A | * | 3/1960 | Dall ..... 292/109 |
| 2,943,589 | A | | 7/1960 | Lovell et al. |
| 3,036,851 | A | | 5/1962 | Takacs |
| 3,180,303 | A | | 4/1965 | Hamilton |
| 3,348,367 | A | | 10/1967 | Stubblefield et al. |
| 3,733,456 | A | * | 5/1973 | Blackburn ..... 219/724 |
| 3,861,083 | A | | 1/1975 | Goiot ..... 49/193 |
| 3,896,595 | A | * | 7/1975 | Anghinetti et al. ..... 52/19 |
| 3,976,024 | A | | 8/1976 | Fillery ..... 114/203 |
| 4,021,073 | A | | 5/1977 | Manning ..... 296/137 |
| 4,362,118 | A | | 12/1982 | Koch, Jr. et al. ..... 114/201 |
| 4,613,174 | A | | 9/1986 | Berg et al. ..... 292/136 |
| 5,231,948 | A | * | 8/1993 | Malmanger et al. .... 114/201 R |

(Continued)

FOREIGN PATENT DOCUMENTS

| | | | |
|---|---|---|---|
| JP | 359057086 | 4/1984 | ..... 114/203 |

(Continued)

*Primary Examiner*—Sherman Basinger
(74) *Attorney, Agent, or Firm*—Knobbe, Martens, Olson & Bear LLP

(57) ABSTRACT

An apparatus having at least one paw hingedly attached to a compartment side of a lid configured for covering a hatch of a compartment. At least one catch is positioned on a wall of said hatch for engagingly receiving the at least one paw. A spring is positioned for urging engagement of the paw with the catch. The paw includes an angled portion which, upon closing of the lid, rotates the paw to allow the lid to be closed over the hatch and the paw to then engage the catch. A user may rotate the paw to disengage the paw from the catch, to thereby open the lid.

36 Claims, 4 Drawing Sheets

U.S. PATENT DOCUMENTS

| | | | | |
|---|---|---|---|---|
| 5,314,218 | A | 5/1994 | Nadherny | 292/256.5 |
| 5,358,291 | A | 10/1994 | Malmanger et al. | 292/175 |
| 5,566,992 | A | 10/1996 | Anderson et al. | 292/241 |
| 5,704,167 | A | 1/1998 | Swinderman | 49/381 |
| 6,192,823 | B1 * | 2/2001 | Tsumiyama et al. | 114/363 |
| 6,265,662 | B1 * | 7/2001 | Riedy et al. | 174/67 |
| 6,431,615 | B1 | 8/2002 | Bastian | 292/80 |
| 6,460,902 | B1 | 10/2002 | Kyle | 292/165 |
| 6,848,226 | B1 * | 2/2005 | Boyd et al. | 52/220.8 |
| 2002/0135187 | A1 | 9/2002 | Bastian | 292/121 |
| 2003/0030284 | A1 | 2/2003 | Prada et al. | 292/121 |

FOREIGN PATENT DOCUMENTS

| | | | | |
|---|---|---|---|---|
| JP | 361030481 | | 2/1986 | 114/203 |
| JP | 2000-2033 | * | 1/2000 | |

* cited by examiner

APPARATUS, AND ASSOCIATED METHOD, FOR OPERATING A LID TO A HATCH

CLAIM OF PRIORITY

This application claims priority from U.S. Provisional Patent Application Ser. No. 60/361,566 entitled "SIDE LATCH AND LOCK FOR LID OF BOAT DECK HATCH" filed on behalf of Clifford Rabal, on Mar. 4, 2002.

TECHNICAL FIELD

The invention relates generally to lids and, more particularly, to an apparatus and associated method for operating (e.g., opening, closing, and/or securing) a lid to a hatch, such as a boat deck hatch.

BACKGROUND

Boats and, in particular, boat decks, are commonly provided with dry storage areas or compartments having openings, or hatches, covered by upwardly-opening lids. Such lids are typically secured in a closed position with a top flush latch. There are, however, a number of drawbacks inherently associated with lids that utilize top flush latches. For example, such lids are susceptible via the latch to leakage or seepage of water (e.g., from rain or a surrounding body of water) into the compartment. Furthermore, such lids are relatively difficult to open and close, and to ascertain when secured in a closed position. Still further, such lids may also constitute a tripping hazard, and are considered by many to be aesthetically unappealing.

Thus, there is a need for an apparatus and associated method for securing a lid, which apparatus and method preferably also prevents leakage or seepage of water past the lid into an underlying compartment, which is relatively simple to open and close and to ascertain when secured in a closed position, which is not a tripping hazard, and which is aesthetically appealing.

SUMMARY

The present invention, accordingly, provides an apparatus for operating a lid configured for covering a hatch of a compartment. The apparatus comprises at least one paw hingedly attached to a compartment side of the lid. At least one catch is positioned adjacent to the compartment for engagingly receiving the at least one paw.

In one aspect of the invention, a spring hinge is utilized for urging engagement of the paw with the catch. In another aspect of the invention, the paw includes an angled portion which, upon closing of the lid, facilitates rotation of the paw to permit the lid to be closed over the hatch, and the paw to then engage the catch. A user may rotate the paw to disengage the paw from the catch, to thereby open the lid.

The present invention also provides for a method for operating a lid for a hatch of a compartment, wherein the lid is closed by pushing the lid towards the hatch until an angled portion of a paw hingedly attached to a compartment side of the lid rotates past and then engages at least one catch positioned on a wall of the hatch. The lid may be opened by manually urging the paw away from the catch, and pulling the lid away from said hatch.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

In the following discussion, numerous specific details are set forth to provide a thorough understanding of the present invention. However, it will be obvious to those skilled in the art that the present invention may be practiced without such specific details. In other instances, well-known elements have been illustrated in schematic or block diagram form in order not to obscure the present invention in unnecessary detail. Additionally, for the most part, details concerning boat lids and the like have been omitted inasmuch as such details are not considered necessary to obtain a complete understanding of the present invention, and are considered to be within the skills of persons of ordinary skill in the relevant art.

Figure 1:
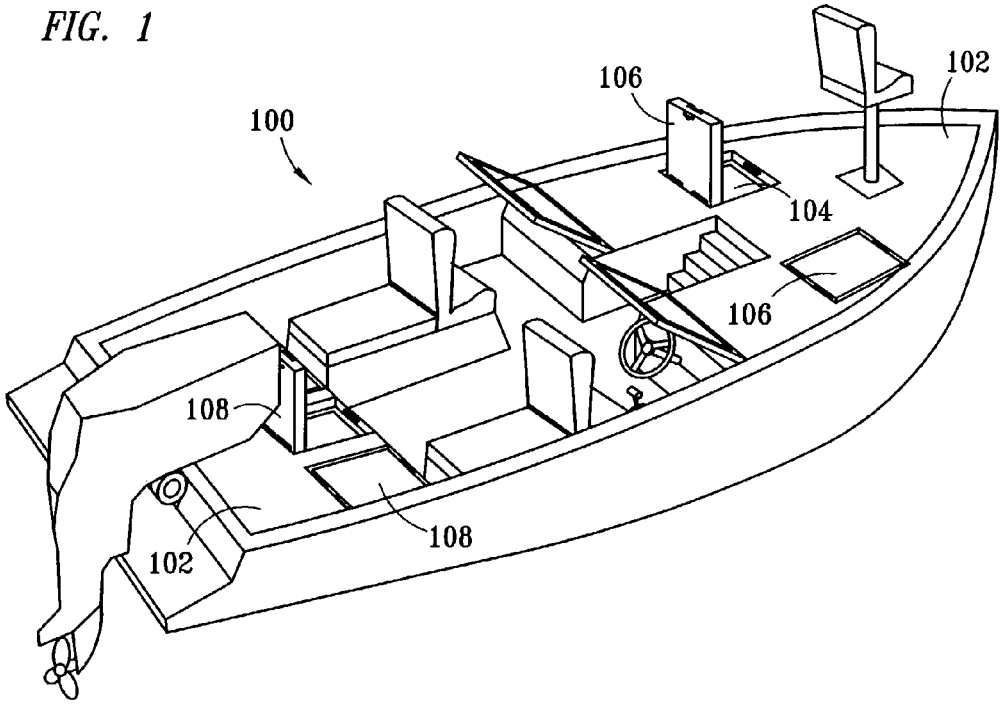
FIG. 1 is a perspective view of a boat utilizing hatch lids embodying features of the present invention.

Referring to FIG. 1 of the drawings, the reference numeral 100 generally designates a boat having relatively horizontal decks 102, beneath which are storage compartments 104

(one of which is shown) having hatches (defined herein to refer to an opening in a compartment) secured with "interior" lids 106 and "exterior" lids 108 embodying features of the present invention. The boat 100 also includes a number of other components, but which are considered to be well-known in the art and will, therefore, not be discussed in further detail herein, except insofar as necessary to describe the present invention.

Figure 2:
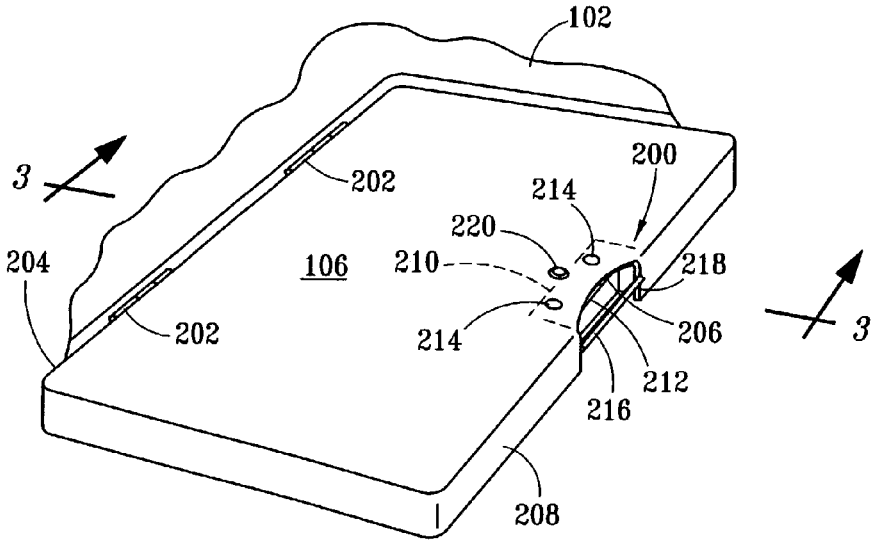
FIG. 2 is a perspective view of a lid of the boat of FIG. 1.
Figure 3:
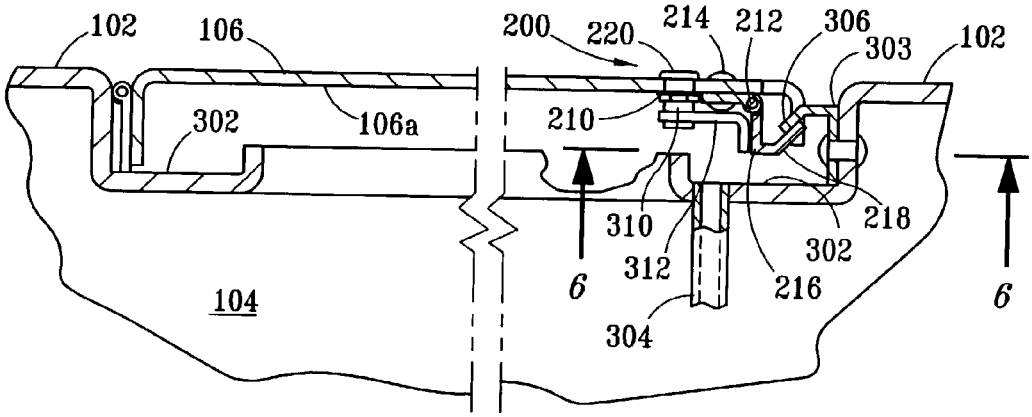
FIG. 3 is a cross-sectional view of the lid of FIG. 2 taken along the line 3—3 of FIG. 2.

FIG. 2 depicts a perspective view of an interior lid 106 having one or more hinges 202 for hinged attachment of a first edge 204 of the lid 106 to the deck 102 (FIG. 1). A cut-out 206, preferably semi-circular, is defined preferably at an approximately central position of a second edge 208 opposing the first edge 204. A fixed hinge plate 210 having a spring hinge joint 212 is attached to a compartment side (i.e., underside, as viewed in FIG. 2) of the lid 106 adjacent to the cut-out 206, using conventional fasteners 214, such as rivets, bolts, and the like. A rotatable hinge plate 216 having at least one paw 218 extending at an angle therefrom is rotatably attached to the hinge joint 212 for securing the second edge 208 of the lid 106 to the deck 102 in a closed position over a compartment 104, as shown in FIG. 3 and as discussed in further detail below. A lock mechanism 220, operable for example via a key, discussed further below, extends through the lid 106 adjacent to the hinge plate 216.

FIG. 3 is a cross-sectional view of the interior lid 106 taken along the lines 3—3 of FIG. 2. As shown therein, a water channel, referred to herein as a rain lip, 302 extends inwardly from a wall 303 of the hatch around the interior perimeter of the hatch for collecting water (e.g., from rain or a surrounding body of water) that leaks or seeps past the lid 106 toward the compartment 104. A drain hose 304 is connected to the rain lip 302 for draining off, in a conventional manner, water collected by the rain lip 302.

Figure 5:
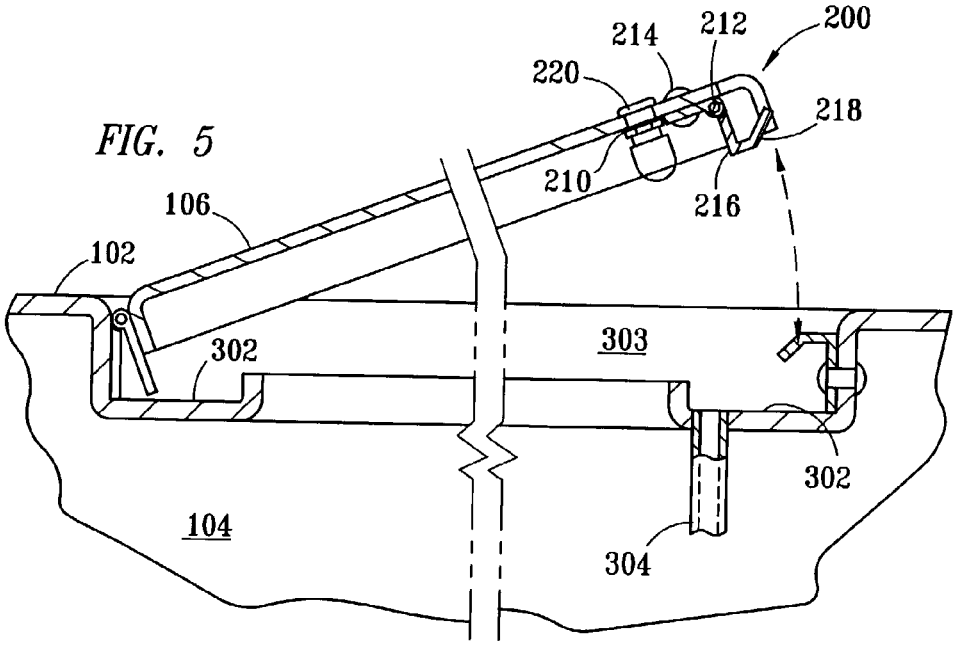
FIG. 5 depicts operation of the lid of FIGS. 2–4.

As discussed above, the fixed hinge plate 210 is secured to the compartment side 106*a* of the lid 106, adjacent to the cut-out 206 using the fasteners 214. The rotatable hinge plate 216 is hingedly attached to the fixed hinge plate 210 via the hinge pin 212. There are preferably two spaced-apart paws 218, though one or more paws may be utilized, extending at an angle (such as, about, 45*) from the rotatable hinge plate 216 for engaging one or more catches 306 secured to a wall of the hatch, designated by the reference numeral 303. The spring hinge 212 is configured for urging the paws 218 in engagement with the catch 306. The spring hinge 212 is sized so that the paws 218 will rotate as shown in FIG. 5 when the lid 106 being moved downwardly into a closed position, or when a user inserts fingers (not shown) through the cut-out 206 to press against the paws 218 and disengage the paws 218 from the catches 306 to thereby open the lid 106.

Figure 4:
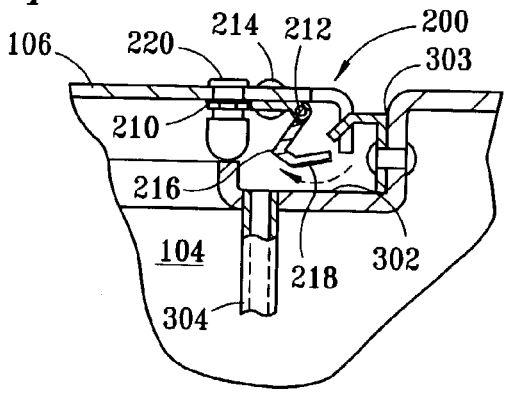
FIG. 4 depicts operation of a latch mechanism of the lid of FIGS. 2–3.
Figure 6:
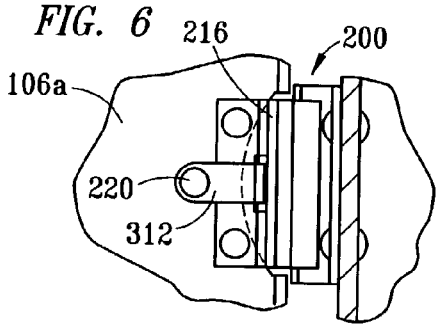
FIG. 6 shows a latch utilized by the lid of FIGS. 2–5 in a locked position.
Figure 7:
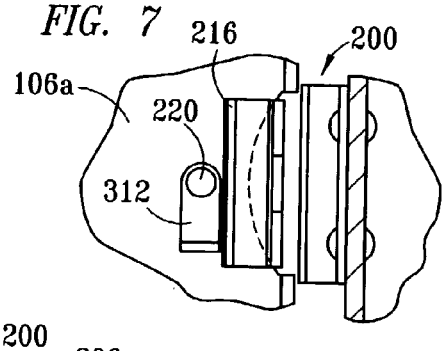
FIG. 7 shows a latch utilized by the lid of FIGS. 2–5 in an unlocked position.

As also shown in FIG. 3, a lock mechanism 310 is rotatably secured to the lid 106 using conventional fasteners. The lock mechanism 310 includes a cam 312 which is rotatable about a vertical axis, as viewed in FIG. 3, between a locked position, as depicted in FIGS. 3 and 6, and an unlocked positioned, as depicted in FIGS. 4, 5, and 7. The lock mechanism 310 and cam 312 is, furthermore, placed in the locked position or the unlocked position via a conventional key mechanism 220, which extends through the lid 106, as also depicted in FIG. 2.

FIG. 4 illustrates rotation of the hinge 216 and paw 218 for opening or closing the lid 106. FIG. 5 illustrates the lid 106 in a partially open position.

FIG. 6 depicts the position of the cam 312 when the lock mechanism 220 is activated to lock the lid 106 in a closed position to thereby prevent it from being opened. FIG. 7 depicts the position of the cam 312 when the lock mechanism 220 is activated to unlock the lid 106, thereby permitting it to be opened.

In operation, the lid 106 may be closed by simply closing the lid 106 onto the hatch. When the paw 218 abuts the catch 306, the hinge plate 216 rotates to permit the lid 106 to be closed onto the hatch, at which time the spring hinge 212 then urges the paw 218 to engage the catch 306 to thereby secure the hatch in a closed position. The lid 106 may be locked in a closed position by turning the cam 312 until it abuts the hinge plate 216. The lid 106 may be opened by pressing with fingers inwardly on the hinge plate 216 until the paw 218 disengages from the catch 306 and then lifting the lid 106 open. If the cam 312 is in a locked position, then it would be rotated out of a locked position before opening the lid 106.

Figure 8:
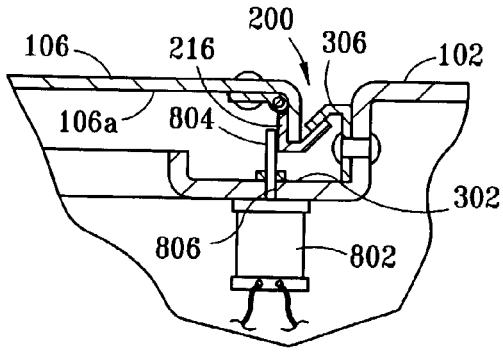
FIG. 8 shows an alternate embodiment of the latch of FIGS. 2–7 configured with an electric lock mechanism.

FIG. 8 depicts an alternate embodiment of the present invention having an electrically operable lock mechanism. Accordingly, a solenoid 802 is mounted on the underside (as viewed in FIG. 8) of the rain lip 302, and is suitably connected for electrical power and control. An actuator stem 804 extends from the solenoid 802 through a sealed hole 806 formed in the rain lip 302. As shown in FIG. 8 depicts an alternate embodiment of the present invention having an electrically operable lock mechanism. Accordingly, a solenoid 802 is mounted on the underside (as viewed in FIG. 8) of the rain lip 302, and is suitably connected for electrical power and control. An actuator stem 804 extends from the solenoid 802 therough a sealed hole 806 formed in the rain lip 302. As shown in FIG. 8, the stem 804 is extended to abut the hinge 216, thereby disabling the hinge 216 and paw 218 from disengaging from the catch 306. Upon retraction of actuator stem 804, the stem 804 moves downwardly to permit movement of the hinge 216 and paw 218, thereby unlocking the latch 200.

Figure 9:
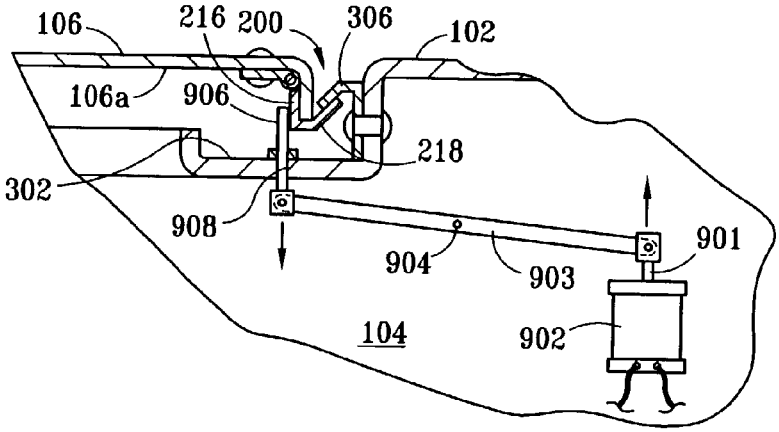
FIG. 9 shows an alternate embodiment of the latch of FIG. 8 configured with an leveraged electric lock mechanism.

FIG. 9 depicts a second alternate embodiment of the present invention having an electrically operable lock mechanism. Accordingly, a solenoid 902 is mounted at a suitable location within the compartment 104, and is suitably connected for electrical power and control. An actuator stem 901 extends from the solenoid 902 and is connected to one end of a lever 903 pivotably mounted at a pivot 904. A second end of the lever 903 is connected to a stem 906 extending through a sealed hole 908 formed in the rain lip 302. As shown in FIG. 9, the stem 906 is extended to abut the hinge 216, thereby disabling the hinge 216 and paw 218 from disengaging from the catch 306, thereby locking the latch 200. Upon retraction of the actuator stem 901, the stem 906 moves downwardly to permit movement of the hinge 216 and paw 218, thereby unlocking the latch 200.

Figure 10:
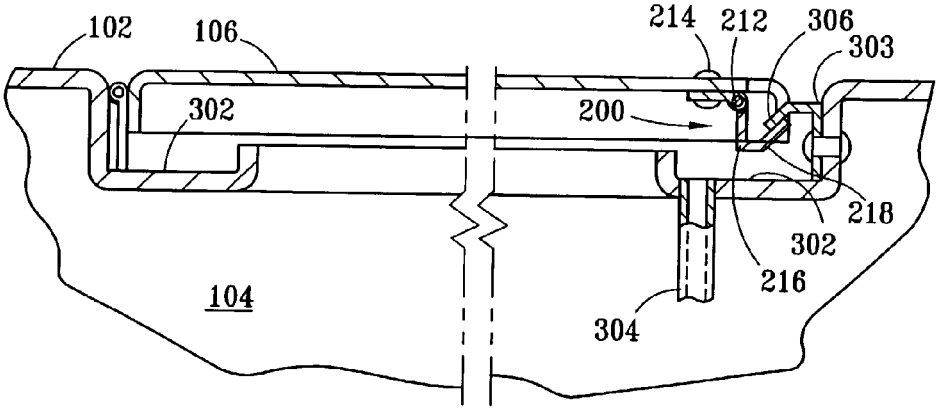
FIG. 10 shows an embodiment of the lid of FIGS. 2–9 configured without a lock mechanism.

FIG. 10 shows an alternate embodiment of the lid 106 and latch 200 of FIGS. 2–5, but without a lock mechanism 220.

Figure 11:
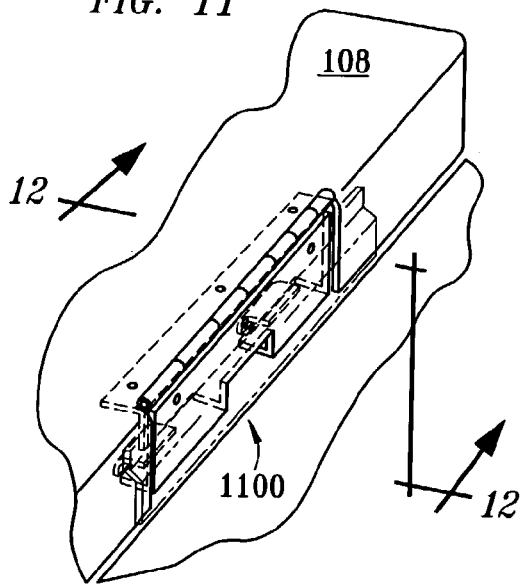
FIG. 11 shows an alternate embodiment of the latch of FIGS. 2–7 configured for opening outwardly for operation with an exterior lid.
Figure 12:
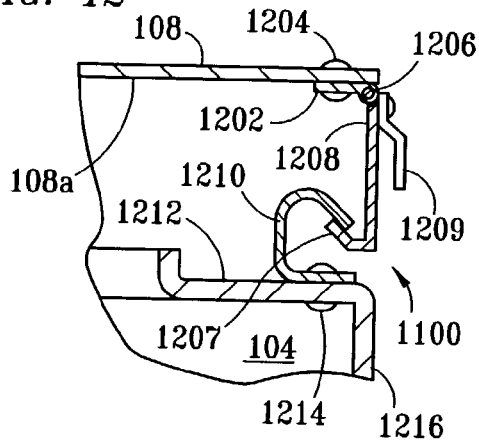
FIG. 12 is a cross-sectional view of the lid of FIG. 11 taken along the line 12—12 of FIG. 11.

FIG. 11 is a perspective view of a latch mechanism 1100 utilized with the "exterior" lid 108 (FIG. 1), configured for use where the deck surface 102 does not abut the latch mechanism 1100. FIG. 12 shows a cross-sectional view of the lid 108 taken along the line 12—12 of FIG. 11. As shown therein, a fixed hinge plate 1202 is secured to a compartment-side 108*a* of the lid 108 using conventional fasteners 1204, such as rivets, and the like. A rotatable hinge plate 1208, having at least one paw 1207 extending therefrom, is rotatably connected to the fixed hinge plate 1202 via a spring hinge joint 1206. The hinge plate 1208 further includes a handle 1209 for grasping the hinge plate 1208 and rotating it outwardly. A catch 1210 is mounted onto a rain lip 1212 for receiving and engaging the paw 1210.

In operation, the lid 108 may be closed by simply closing the lid 108 onto the hatch. When the paw 1207 abuts the catch 1210, the hinge plate 1208 rotates to permit the lid 108 to be closed onto the hatch, at which time the spring hinge 1206 then urges the paw 1207 to engage the catch 1210 to thereby secure the hatch in a closed position. Conversely, the lid 108 may be opened by pulling outwardly on the hinge plate 1208 handle 1209 until the paw 1207 disengages from the catch 1210 and then lifting the lid 108 open.

Figure 13:
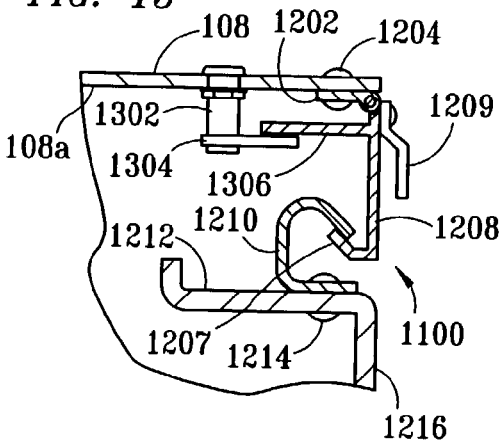
FIG. 13 shows an alternate embodiment of the latch of FIGS. 11–12 configured with an electric lock mechanism.

FIG. 13 depicts an alternate embodiment of the latch 1100 in which, in addition to the features described above, further includes a lock mechanism 1302, operable, for example, via a key, mounted to the compartment-side 108*a* of the lid 108. The hinge plate 1208 includes a tab attached thereto and extending toward the lock 1302. The lock 1302 includes a cam 1304 rotatably attached thereto, which may be rotated by the lock mechanism 1302 to abut the underside (as viewed in FIG. 13) of the tab 1306 and, thereby, prevent the hinge plate 1208 from disengaging from the catch 1210, thereby locking the lid 108 in a closed position.

Figure 14:
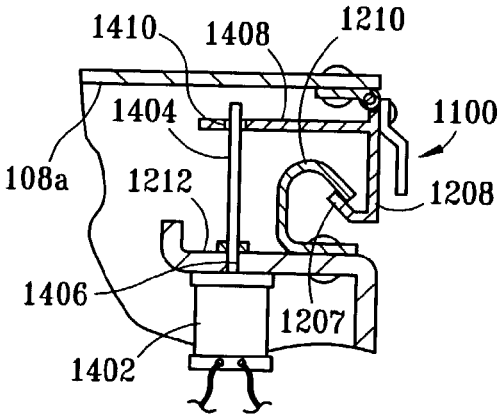
FIG. 14 shows an alternate embodiment of the latch of FIGS. 11–13 configured with an electric lock mechanism.

FIG. 14 depicts an alternate embodiment of the present invention shown in FIGS. 11 and 12, in which an electrically operable lock mechanism is provided therewith. Accordingly, a solenoid 1402 is mounted on the underside (as viewed in FIG. 14) of the rain lip 1212, and is suitably connected for electrical power and control. An actuator stem 1404 extends from the solenoid 1402 through a sealed hole 1406 formed in the rain lip 1212. The hinge plate 1208 is provided with a tab extending therefrom with a hole 1410 formed therein for receiving the stem 1404. Accordingly, when the solenoid 1402 is activated, the stem 1404 extends to and through the hole 1410, thereby disabling the hinge plate 1208 and paw 1207 from disengaging from the catch 1210. Upon retraction of the actuator stem 1404, the stem 1404 moves downwardly to permit movement of the hinge 1208 and paw 1207, thereby unlocking the latch 1100.

Figure 15:
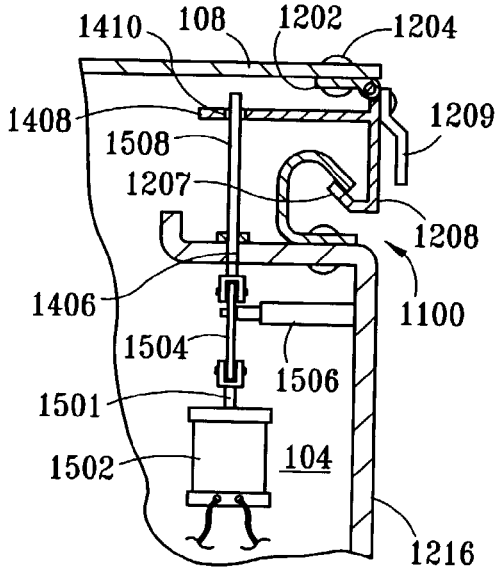
FIG. 15 shows an alternate embodiment of the latch of FIG. 14 configured with an leveraged electric lock mechanism.

FIG. 15 depicts an alternate embodiment of the present invention shown in FIG. 13, in which the electrically operable lock mechanism is provided with a lever. Accordingly, a solenoid 1502 is suitably mounted on the compartment 104, and is suitably connected for electrical power and control. An actuator stem 1501 extends from the solenoid 1502 and connects to one end of a lever 1504, which is pivotably mounted on a pivot 1506. The other end of the lever 1504 is connected to a stem 1508 configured for extending through the sealed hole 1406 formed in the rain lip 1212. When the solenoid 1502 is activated, the stem 1404 extends to and through the hole 1410, thereby disabling the hinge plate 1208 and paw 1207 from disengaging from the catch 1210. Upon retraction of the actuator stem 1404, the stem 1404 moves downwardly to permit movement of the hinge 1208 and paw 1207, thereby unlocking the latch 1100.

By using the present invention, dry storage areas or compartments having openings, or hatches, may be provided with lids that are not susceptible via a latch to leakage or seepage of water (e.g., from rain or a surrounding body of water) into the compartment. In contrast to lids disclosed in the prior art, lids of the present invention are also relatively easy to open and close and, as well, to ascertain when secured in a closed position. Still further, such lids of the present invention do not constitute a tripping hazard, and are aesthetically appealing.

It is understood that the present invention may take many forms and embodiments. Accordingly, several variations may be made in the foregoing without departing from the spirit or the scope of the invention. For example, the a lid may be provided with latch mechanisms described herein on both edges 204 and 208 of the lid 106 or 108. Applications of the present invention may be extended to aircraft and the like. In another variation, the solenoid actuated lock mechanisms depicted in FIGS. 8, 9, 14, and 15 may be configured and/or mounted in different orientations. For example, the solenoid may be mounted on the compartment side of the lids 106 and 108. In another variation, the paws 218 and 1207 and/or the catches 306 1210 may be shaped and/or curved differently to more readily facilitate rotation of the respective paws during closing of the lids respective 106 and 108.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. An apparatus for operating a lid configured for covering a hatch of a compartment a first surface extending along the hatch in a first plane, the lid having a second surface extending substantially in the first plane, and a wall extending from the first surface and generally perpendicular to the first surface, said apparatus comprising:

at least one paw hingedly attached to a compartment side of said lid; and at least one catch positioned on the wall of said hatch for engagingly receiving said at least one paw, said paw being directly accessible and operable from outside the hatch through an opening between the lid and the wall to disengage the paw from the catch.

2. The apparatus of claim 1, wherein said at least one paw comprises an angled portion configured for urging said at least one paw to rotate away from said at least one catch when said lid is being closed; and for engaging said at least one catch when said lid is in a closed position.

3. The apparatus of claim 1, wherein said at least one paw may from an edge of said lid be accessed and disengaged from said at least one catch.

4. The apparatus of claim 1, further comprising a cut-out defined in an edge of said lid for facilitating access to said at least one paw for disengagement of said at least one paw from said at least one catch.

5. The apparatus of claim 1, further comprising an opening defined in said lid for facilitating access to said at least one paw for disengagement of said at least one paw from said at least one catch.

6. The apparatus of claim 1, further comprising at least one spring connected to said at least one paw for urging said at least one paw in engagement with said at least one catch.

7. The apparatus of claim 1, further comprising at least one spring connected to said at least one paw for urging said at least one paw away from said lid for engagement with said at least one catch.

8. The apparatus of claim 1, further comprising at least one spring connected to said at least one paw for urging said at least one paw toward said lid for engagement with said at least one catch.

9. The apparatus of claim 1, wherein said at least one catch is secured adjacent to said compartment.

10. The apparatus of claim 1, further comprising a lock mechanism attached to said lid, said lock mechanism being operable for preventing said paw from being disengaged from said catch.

11. The apparatus of claim 1, further comprising:

a lock mechanism operably attached to said lid for preventing said at least one paw from being disengaged from said at least one catch; and a solenoid operably connected to said lock mechanism for activating said lock mechanism.

12. The apparatus of claim 1, further comprising:

a lock mechanism operably attached to said lid for preventing said at least one paw from being disengaged from said at least one catch;

a lever connected at a first end to said lock mechanism; and a solenoid operably connected to a second end of said lever for activating said lock mechanism.

13. The apparatus of claim 1, wherein said compartment is defined within a deck of a boat.

14. The apparatus of claim 1, wherein a wall of said hatch comprises a rain lip configured for collecting water that passes over an edge of said lid, and wherein said at least one catch is positioned between said hatch and said rain lip.

15. The apparatus of claim 1, wherein a wall of said hatch comprises a rain lip configured for collecting water that passes over an edge of said lid, and a drain for transferring water collected in said rain lip away from said rain lip, and wherein said at least one catch is positioned between said hatch and said rain lip.

16. A method for operating a lid configured for covering a hatch of a compartment a first surface extending along the hatch in a first plane, the lid having a second surface extending substantially in the first plane, and a wall extending from the first surface and generally perpendicular to the first surface, said method comprising the steps of:

closing said lid by pushing said lid towards said hatch until an angled portion of at least one paw hingedly attached to a compartment side of said lid rotates past and then engages at least one catch positioned on the wall of said hatch; and opening said lid by manually and directly acting against said at least one paw through an opening between the lid and the wall to urge said at least one paw away from said catch, and pulling said lid away from said hatch.

17. A latching mechanism for a watercraft having a deck, a hatch in the deck, the deck having a first surface extending along the hatch in a first plane opening into a compartment disposed below at least a portion of the deck, the compartment defined at least in part by a wall extending generally perpendicular to the first surface, and a lid being hinged to the deck and covering at least a portion of the hatch when closed the lid having a second surface extending substantially in the first plane the hatch latching mechanism comprising at least one pawl that is accessible from a deck side of the lid through an opening between the lid and the wall so as to be directly actuated from above, and a catch positioned on to the wall of the hatch below the portion of the deck in a position interacting with the pawl, the pawl being rotatably attached to an inner side of the lid so as to pivot between at least a latched position, in which the pawl engages with the catch, and an unlatched position, in which the pawl is disengaged from the latch, the pawl rotating toward a hinged side of the lid when being disengaged from the catch.

18. The method of claim 16, wherein the step of manually urging said paw away from said catch further comprises the steps of:

accessing said at least one paw from an edge of said lid; and urging said at least one paw away from said catch until said at least one paw is disengaged from said at least one catch.

19. The method of claim 16, wherein the step of manually urging said paw away from said catch further comprises the steps of:

accessing said at least one paw from a cut-out of said lid; and urging said at least one paw away from said catch until said at least one paw is disengaged from said at least one catch.

20. The method of claim 16, wherein the step of manually urging said paw away from said catch further comprises the steps of:

accessing said at least one paw through an opening in said lid; and urging said at least one paw away from said catch until said at least one paw is disengaged from said at least one catch.

21. The method of claim 16, wherein the step of manually urging said paw away from said catch further comprises urging said at least one paw against the resistance of a spring.

22. The method of claim 16, wherein the step of manually urging said paw away from said catch further comprises urging said at least one paw against the resistance of a spring toward said lid.

23. The method of claim 16, wherein the step of manually urging said paw away from said catch further comprises urging said at least one paw against the resistance of a spring away said lid.

24. The method of claim 16, further comprising the step of locking said paw in engagement with said catch.

25. The method of claim 16, further comprising the step of electrically activating a mechanism to lock said paw in engagement with said catch.

26. The method of claim 16, further comprising the step of electrically activating a leveraged mechanism to lock said paw in engagement with said catch.

27. The latch mechanism of claim 17, wherein the wall of said hatch is integrally defined by the deck of the watercraft.

28. The latch mechanism of claim 17, wherein the wall of said hatch comprises a rain lip configured for collecting water that passes over an edge of said lid, and wherein said catch is positioned between said rain lip and said lid.

29. The apparatus of claim 1, wherein the paw is biased toward said catch.

30. The apparatus of claim 1, wherein the paw rotates toward a hinged end when disengaging from the catch.

31. The latch mechanism of claim 17, wherein said pawl comprises an angled portion configured for urging said pawl to rotate away from said catch when said lid is being closed; and for engaging said catch when said lid is in a closed position.

32. The latching mechanism of claim 17, wherein the pawl is biased toward the catch.

33. The latching mechanism of claim 17, wherein the catch includes an angled surface that extends away from the hatch wall in a generally downward direction, and the pawl includes an angled surface that extends upward generally in an outward direction away from a center of the lid, and wherein the angled surfaces of the catch and pawl are disposed so as to interact with one another when the lid is being closed.

34. The latching mechanism of claim 33, wherein the pawl includes an arm that lies between a hinged portion of the pawl and the angled surface of the pawl, and at least the arm is accessible from the deck side of the lid.

35. The latching mechanism of claim 17, additionally comprising means for rotating the pawl relative to the catch when closing the lid.

36. The latching mechanism of claim 17, wherein the pawl is coupled to the lid near a perimeter edge of the lid.

* * * * *